United States Patent [19]

Amtmann et al.

[11] 4,171,487

[45] Oct. 16, 1979

[54] X-RAY DIAGNOSTIC GENERATOR IN WHICH THE X-RAY TUBE VOLTAGE IS REGULATED VIA THE X-RAY TUBE CURRENT

[75] Inventors: Heribert Amtmann, Buckenhof; Hans Ebersberger; Guenther Eckardt, both of Nuremberg; Hans-Joachim Greiner, Buckenhof, all of Fed. Rep. of Germany

[73] Assignee: Siemens Aktiengeselleschaft, Berlin & Munich, Fed. Rep. of Germany

[21] Appl. No.: 914,168

[22] Filed: Jun. 9, 1978

[30] Foreign Application Priority Data

Jul. 22, 1977 [DE] Fed. Rep. of Germany ..... 2733249

[51] Int. Cl.[2] ..... H05G 1/12; H05G 1/32; H05G 1/34

[52] U.S. Cl. ..... 250/408; 250/421

[58] Field of Search ..... 250/421, 408, 409

[56] References Cited

U.S. PATENT DOCUMENTS 3,974,387 8/1976 Brönner ..... 250/409

FOREIGN PATENT DOCUMENTS 2122138 11/1972 Fed. Rep. of Germany .

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In an exemplary embodiment, in order to operate the X-ray diagnostic generator with a decreasing (or "falling") load during an X-ray exposure, there is disposed in the primary circuit of the high voltage transformer a bridge rectifier in whose D.C. current branch there is disposed a series of networks each consisting of at least one resistance and one capacitor in parallel, and a switch for the purpose of switching the network into and out of the circuit. A timing control initially short circuits the resistance-capacitance networks to provide for maximum primary current at the start of an exposure, the shunt capacitor absorbing such primary current when each resistance-capacitance network is first switched into the circuit to initiate a relatively smoothly decreasing primary current as a function of time. As secondary voltage tends to decrease, the X-ray tube current is progressively reduced to maintain the selected X-ray tube voltage, the result being the desired smoothly decreasing load characteristic.

5 Claims, 1 Drawing Figure

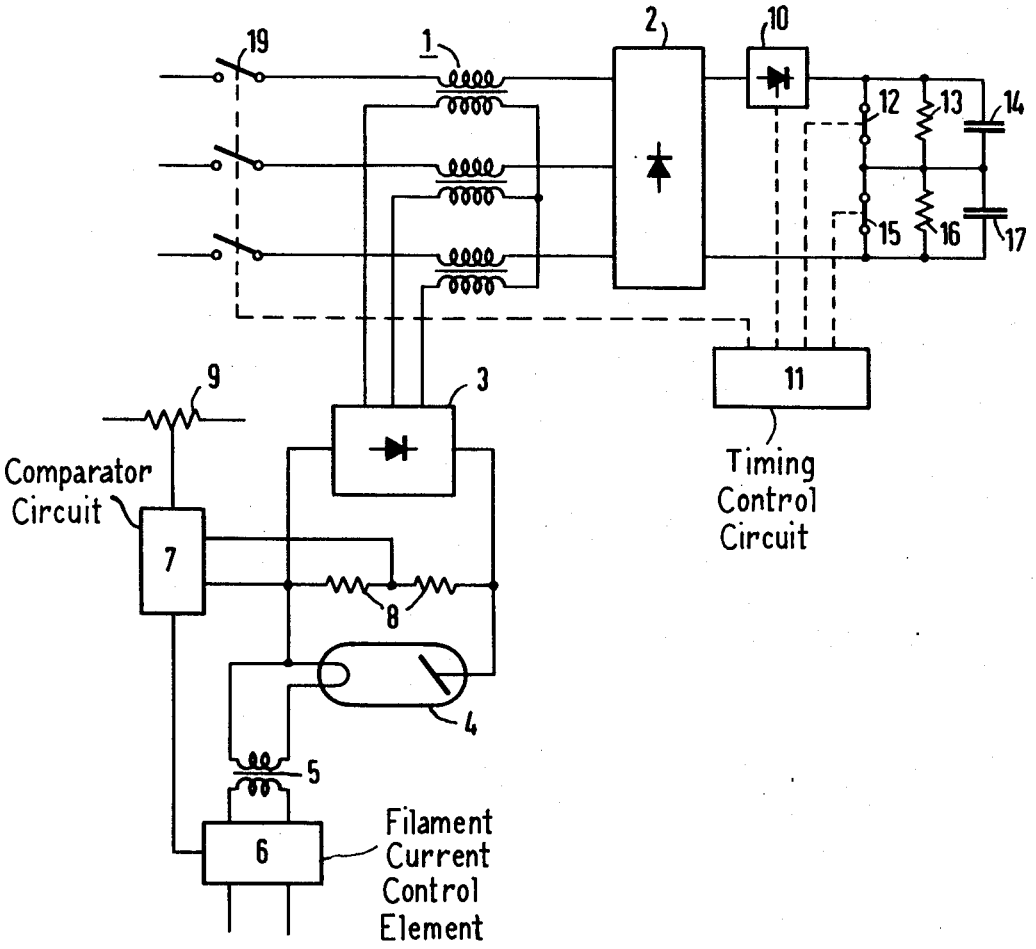
19
1
2
10
12
13
14
15
16
17
9
3
11
Comparator Circuit
7
8
4
5
6
Filament Current Control Element
Timing Control Circuit

X-RAY DIAGNOSTIC GENERATOR IN WHICH THE X-RAY TUBE VOLTAGE IS REGULATED VIA THE X-RAY TUBE CURRENT

BACKGROUND OF THE INVENTION

The invention relates to an X-ray diagnostic generator exhibiting a fixed or switchable no-load output voltage of the high voltage transformer, and comprising a control circuit for the X-ray tube voltage which contains a comparator member for comparing the actual value of the X-ray tube voltage with a nominal value, as well as a control element for the heating current of the X-ray tube for the purpose of achieving conformity of the actual value of the X-ray tube voltage with the nominal value.

An X-ray diagnostic generator of this type is described in the U.S. Pat. No. 3,974,387. In the case of an X-ray diagnostic generator such as this, the voltage drop at the internal resistance of the X-ray generator is adjusted such that the respectively desired X-ray tube voltage is connected to the X-ray tube. If the actual value of the X-ray tube voltage, in comparison with the nominal value, for example, is too high, an increase in the X-ray tube current results. Consequently, the voltage drop at the internal resistance of the X-ray generator increases and the X-ray tube voltage decreases. In the inverse case, an increase in the X-ray tube voltage results through a reduction of the X-ray tube current.

It is known that an optimum utilization of the load carrying capacity of the X-ray tube, and hence a very short photographic exposure time for X-ray photographs can be achieved if an X-ray diagnostic generator is operated with a decreasing (or "falling") load; i.e., if the X-ray tube power output is exponentially decreased from a peak value at the commencement of an X-ray photograph to a constant value. To this end, it is known e.g. from the German Offenlegungsschrift 2,122,138 to exponentially decrease the X-ray tube current from a peak value at the commencement of an X-ray photograph corresponding to the course of the maximally permissible X-ray tube power. However, this principle is not applicable in the case of an X-ray diagnostic generator of the type initially cited, since the X-ray tube current is, of course, utilized for the purpose of regulating the X-ray tube voltage.

SUMMARY OF THE INVENTION

The object underlying the invention consists in constructing an X-ray diagnostic generator of the type initially cited such that the X-ray tube power during an X-ray photograph is reduced from an initial value to a constant value.

In accordance with the invention, this object is achieved by virtue of the fact that there is present, for the purpose of adjusting the X-ray tube power, at least one resistance capable of being connected into the circuit of the X-ray tube by means of a switch, with which resistance a capacitor is connected in parallel, and that the parallel-connection of resistance and capacitor is dimensioned such that its time constant is approximately equal to the time constants of the control circuit of the X-ray tube voltage. In the inventive X-ray diagnostic generator, a stepwise (or step-by-step) change for the purpose of reducing the X-ray tube power does not take place, but, on the contrary, a gradual change occurs, because the load current, in the moment of connection of the resistance, is initially taken over by the shunt capacitor, and the resistance becomes effective only upon charging of the capacitor. In contrast with the instance in which a resistance without a capacitor is connected in step-by-step fashion into the circuit of the X-ray tube, there thus results, in the case of the inventive X-ray diagnostic generator, no impermissible intrusion (abrupt change) of the X-ray tube voltage directly following connection of the resistance into the circuit.

An expedient embodiment of the invention consists in that there is disposed in the primary circuit of the high voltage transformer a bridge rectifier in whose direct current branch there is disposed the parallel-connection consisting of the resistance and capacitor, and parallel thereto, the switch.

The invention shall be explained in greater detail in the following on the basis of the sample embodiment illustrated on the accompanying sheet of drawings; and other objects, features and advantages will be apparent from this detailed disclosure and from the appended claims.

ON THE DRAWINGS

The single FIGURE is a circuit diagram illustrating an exemplary embodiment of X-ray diagnostic generator in accordance with the present invention.

DETAILED DESCRIPTION

In the drawing, a three-phase high voltage transformer 1 is illustrated which is fed by a three-phase supply network (or mains) and in the primary circuit of which there is disposed a three-phase bridge rectifier 2. The secondary windings of the high voltage transformer 1 feed an X-ray tube 4 via a high voltage rectifier 3. The heating (or filament) current of the X-ray tube 4 is delivered by a filament supply transformer 5 whose primary winding is connected to the mains supply via a control element 6 for the heating current and hence for the X-ray tube current. The heating current is determined by a comparator circuit 7 which compares a signal tapped at a voltage divider 8, said signal representing the actual value of the X-ray tube voltage, with a nominal value signal tapped at a nominal value transmitter 9 for the X-ray tube voltage, and which influences the heating current of the X-ray tube 4 and hence the X-ray tube current in dependence upon the difference between the actual and nominal values of the X-ray tube voltage, with the object of achieving a conformity (or approximation) of the actual value to the nominal value.

In order to determine the photographic exposure time of an X-ray photograph, either a mechanical switch 19 is disposed in the A.C. current primary circuit, or an electronic switch 10 is disposed in the D.C. current branch of the bridge rectifier 2, which electronic switch 10 is controlled by a timing control device 11. In order to reduce the X-ray tube power during a photograph, there is provided the series-connection consisting of two parallel networks in the D.C. current branch of the bridge rectifier 2, of which the first parallel network consists of a switch 12, a resistance 13, and a capacitor 14, and the second parallel network consists of a switch 15, a resistance 16, and a capacitor 17.

In the illustrated position of switches 12 and 15, upon closing of switch 10 at the commencement of an X-ray photograph, the maximum X-ray tube power occurs. Following the pre-programmed period of time, the timing control device 11 opens switch 12 such that resistance 13 is connected into the primary circuit of the high voltage transformer 1. At the moment of connection, the primary load current is initially taken over by capacitor 14, such that this connection of resistance 13 does not produce an abrupt change in primary current, but tends to reduce primary current in an exponential fashion corresponding to the time constant of the RC element 13, 14. The control circuit 6 through 9 for the X-ray tube voltage thus has time to correspondingly readjust the X-ray tube voltage via the X-ray tube current. After a predetermined period of time has elapsed, timing control device 11 also opens switch 15, such that the resistance 16 is also connected into the primary circuit of the high voltage transformer 1, and a further reduction of the X-ray tube power takes place. The latter connection also proceeds exponentially corresponding to the charging of capacitor 17.

Without capacitors 14 and 17, when switch 12 is opened, the X-ray tube current would fail to respond to the sudden drop in X-ray tube voltage on account of the relatively slow temperature response of the filament of X-ray tube 4 to the abrupt decrease in filament current, and, accordingly, the X-ray tube voltage would initially drop sharply. This intrusion (or abrupt change) would then be compensated with a time delay which is essentially determined by the inertia or response time of the heating filament of X-ray tube 4. This drop in the X-ray tube voltage upon opening switch 12 and, correspondingly, also upon opening switch 15, is avoided in the case of the illustrated X-ray diagnostic generator through capacitors 14 and 17. To this end, the time constant of the RC-circuits 13, 14, 16, 17, is dimensioned corresponding to the time constants of the control circuit 6 through 9 for the X-ray tube voltage. The time constant of this control circuit is essentially determined by the inertia (or response time) of the heating filament of X-ray tube 4. In order to terminate the photographic exposure, the switch 19 or 10 is opened; the capacitors 14 and 17 must first be discharged via resistances 13 and 16 before switches 12 and 15 close again.

The invention is described in conjunction with two resistances capable of being connected into the primary circuit of the high voltage transformer of an X-ray diagnostic generator. Within the scope of the invention, however, it is also conceivable to connect only one such resistance or more than two resistances, together with the parallel-connected capacitors, corresponding to the desired course of the power reduction during an X-ray photograph. The switches may be designed for a relatively low breakdown capacity, since the load current, at the moment of switching, is taken over by the capacitors.

It will be apparent that many modifications and variations may be effected without departing from the scope of the novel concepts and teachings of the present invention.

We claim as our invention:

1. An X-ray diagnostic generator exhibiting a fixed or switchable no-load output voltage of the high voltage transformer, and comprising a control circuit for the X-ray tube voltage, which contains a comparator member for comparing the actual value of the X-ray tube voltage with a nominal value, as well as a control element for the heating current of the X-ray tube, said control element being controlled by the output signal of the comparator member, for the purpose of effecting a conformity of the actual value of the X-ray tube voltage with the nominal value, characterized in that, in order to adjust the X-ray tube power, there is present at least one resistance (13, 16), capable of being connected into the circuit of the X-ray tube (4) by means of a switch (12, 15), with which resistance (13, 16) a capacitor (14, 17) is parallel-connected, and that the parallel-connection consisting of the resistance (13, 16) and capacitor (14, 17) is dimensioned such that its time constant is approximately equal to the time constants of the control circuit (6 through 9) for the X-ray tube voltage.

2. An X-ray diagnostic generator according to claim 1, characterized in that there is disposed in the primary circuit of the high voltage transformer (1) a bridge rectifier (2) in the direct current branch of which there is disposed a parallel-connection consisting of resistor (13, 16) and capacitor (14, 17), and, parallel thereto, a switch (12, 15).

3. An X-ray diagnostic generator according to claim 1, characterized in that there are present a plurality of resistances (13, 16) capable of connection into the circuit of the X-ray tube (4) in a step-by-step fashion by means of one switch in each instance (12, 15), each of these resistances being bridged by one capacitor (14, 17) each.

4. An X-ray diagnostic generator according to claim 1 characterized in that a timing control device (11) is provided for connecting into the circuit the resistance, or resistances, respectively (12, 15).

5. An X-ray diagnostic generator according to claim 2, characterized in that a plurality of parallel-connections, each comprising resistor and capacitor, are sequentially switchable in series into the direct current branch of the bridge rectifier.

* * * * *